US010918129B2

(12) United States Patent
Besso et al.

(10) Patent No.: US 10,918,129 B2
(45) Date of Patent: Feb. 16, 2021

(54) FILTER SEGMENT INCLUDING A SUBSTRATE LOADED WITH A SMOKE-MODIFYING AGENT

(71) Applicant: Philip Morris USA Inc., Richmond, VA (US)

(72) Inventors: Clement Besso, Neuchatel (CH); Charles Kuersteiner, Jouxtens-Mezery (CH)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 16/287,213

(22) Filed: Feb. 27, 2019

(65) Prior Publication Data

US 2019/0191759 A1 Jun. 27, 2019

Related U.S. Application Data

(63) Continuation of application No. 12/952,682, filed on Nov. 23, 2010, now Pat. No. 10,244,788.

(30) Foreign Application Priority Data

Nov. 23, 2009 (EP) ..... 09252666

(51) Int. Cl.
*A24D 3/04* (2006.01)
*A24D 3/02* (2006.01)
(Continued)

(52) U.S. Cl.
CPC ..... *A24D 3/048* (2013.01); *A24D 3/0212* (2013.01); *A24D 3/061* (2013.01); *A24D 3/062* (2013.01); *A24D 3/14* (2013.01); *Y10T 428/298* (2015.01)

(58) Field of Classification Search
CPC ..... A24D 3/0212; A24D 3/048; A24D 3/061; A24D 3/062; A24D 3/14
See application file for complete search history.

(56) References Cited

U.S. PATENT DOCUMENTS 4,281,671 A 8/1981 Bynre et al.
5,356,704 A 10/1994 Phillips et al.
(Continued)

FOREIGN PATENT DOCUMENTS

CN 2464093 12/2001
CN 201365521 12/2009
(Continued)

OTHER PUBLICATIONS

Office Action for corresponding Korean Application No. 10-2012-7015389 dated Jan. 16, 2017 and English translation thereof.
Australian Office Action dated Apr. 28, 2014 in Australian Application No. 2010321168.
First Office Action dated Jul. 2, 2013 in Chinese Application No. 201080052864.8.
(Continued)

*Primary Examiner* — Michael H. Wilson
*Assistant Examiner* — Dionne W. Mayes
(74) *Attorney, Agent, or Firm* — Harness, Dickey & Pierce, P.L.C.

(57) ABSTRACT

A filter segment for use in a filter of a smoking article includes a substrate loaded with at least one smoke-modifying agent. The substrate is located within the body of the filter segment and is formed from filter plug wrap having an air permeability ranging from about 6,000 Coresta units to about 24,000 Coresta units.

10 Claims, 1 Drawing Sheet

(51) Int. Cl.
*A24D 3/06* (2006.01)
*A24D 3/14* (2006.01)

(56) References Cited

U.S. PATENT DOCUMENTS

| | | | | |
|---|---|---|---|---|
| 2004/0255965 | A1 | 12/2004 | Perfetti et al. | |
| 2006/0021624 | A1 | 2/2006 | Gonterman et al. | |
| 2008/0029114 | A1* | 2/2008 | Seitert et al. ..... | A24D 3/048 131/335 |
| 2010/0059073 | A1 | 3/2010 | Hoffmann et al. | |

FOREIGN PATENT DOCUMENTS

| | | | |
|---|---|---|---|
| DE | 102006025738 | B3 | 11/2007 |
| GB | 2236239 | A | 4/1991 |
| JP | H04-267871 | A | 9/1992 |
| JP | 2008-528053 | A | 7/2008 |
| RU | 2254790 | | 6/2005 |
| RU | 2262280 | | 10/2005 |
| TW | 200911142 | | 3/2009 |
| WO | WO-0034041 | | 6/2000 |
| WO | WO-2007/085830 | A2 | 8/2007 |
| WO | WO-2009/024866 | | 2/2009 |
| WO | WO 2009/109433 | A1 | 9/2009 |
| WO | WO-2010/003899 | A1 | 1/2010 |
| WO | WO-2009/078287 | | 4/2011 |

OTHER PUBLICATIONS

Second Office Action dated Mar. 18, 2014 in Chinese Application No. 201080052864.8.
Third Office Action dated Aug. 15, 2014 in Chinese Application No. 201080052864.8.
Office Action dated Jun. 5, 2013 in Colombian Application No. 12104850.
Office Action dated Jan. 11, 2016 in Indonesian Application No. W-00201202422.
Office Action dated Feb. 2, 2015 in Japanese Application No. 2012-539236.
First Examination Report dated Feb. 13, 2013 in New Zealand Application IP No. 599486.
First Office Action dated Apr. 10, 2015 in Philippines Application No. 1-2012-500760.
Second Office Action dated Nov. 27, 2015 in Philippines Application No. 1-2012-500760.
Decision of Granting dated Dec. 16, 2014 in Russian Application No. 2012126176.
Office Action and Search Report dated May 8, 2015 in Taiwanese Application No. 099140346.
European Search Report dated May 3, 2010 for EP 09 252 666.4.
International Search Report and Written Opinion dated Mar. 14, 2011 for PCT/EP2010/007085.

* cited by examiner

FILTER SEGMENT INCLUDING A SUBSTRATE LOADED WITH A SMOKE-MODIFYING AGENT

CROSS-REFERENCE TO RELATED APPLICATIONS

This is a continuation application of U.S. application Ser. No. 12/952,682, filed Nov. 23, 2010, which claims the benefit of priority under 35 U.S.C. § 119 to European Application No. 09252666.4, filed Nov. 23, 2009, the entire contents of each of which are incorporated herein by reference.

BACKGROUND

Filter cigarettes generally include a rod of tobacco cut filler surrounded by a paper wrapper and a cylindrical filter aligned in end-to end relationship with the wrapped tobacco rod and attached thereto by tipping paper. Typically, filter cigarettes are ventilated and allow for the entry of atmospheric air into the cigarette elsewhere than through its front area (that is the end of the cigarette to be lit). In use, the entry of ventilating air dilutes the mainstream smoke in each puff. The higher the level of ventilation, the greater the dilution of the mainstream smoke drawn through the cigarette filter.

In conventional ventilated filter cigarettes, the filter may include a single segment of filtration material, typically cellulose acetate tow, wrapped in porous plug wrap. Alternatively, the filter may be a multi-segment filter including two or more segments of filtration material for the removal of particulate and gaseous components of the mainstream smoke. To enhance or modify the flavor of the mainstream smoke, it is also known to provide filter cigarettes and other smoking articles with single and multi-segment filters that include flavorants.

For example, U.S. Pat. No. 4,281,671 describes a tobacco smoke filter including a rod of tobacco smoke filtering material, such as cellulose acetate tow, a thread passing longitudinally through the body of the rod, and a smoke-modifying agent, such as a flavoring material, carried by the thread. In use, the flavoring material or other smoke-modifying material becomes entrained in smoke passing through the filter. Other filters for smoking articles including flavor-bearing threads or yarns have also been described in the art.

Flavor-bearing threads for use in filters can be formed from cotton or cellulose acetate. There is a need for an improved carrier for smoke-modifying agents for use in filters for smoking articles such as cigarettes.

Summary of Selected Features

The present invention relates to a filter segment including at least one smoke-modifying agent for use in a filter of a smoking article and to a filter and a smoking article including such a filter segment.

In a preferred embodiment, the filter segment includes a substrate loaded with at least one smoke-modifying agent. Preferably, the substrate is located within the body of the filter segment and is formed from filter plug wrap having an air permeability ranging from about 6,000 Coresta units to about 24,000 Coresta units. More preferably, the substrate is formed from filter plug wrap having an air permeability ranging from about 7,500 Coresta units to about 20,000 Coresta units. Even more preferably, the substrate is formed from filter plug wrap having an air permeability ranging from about 10,000 Coresta units to about 14,000 Coresta units.

In the preferred embodiment, the substrate is formed from filter plug wrap having a grammage ranging from about 25 $g/m^2$ to about 80 $g/m^2$.

Also in the preferred embodiment, the substrate is loaded with menthol. Moreover, the substrate can be colored.

In the preferred embodiment, the substrate can be a thread formed from one or more strips of filter plug wrap. Preferably, the substrate has a diameter ranging from about between 0.5 mm to about 3 mm. Also preferably, the substrate extends axially within the body of the filter segment.

In another embodiment, a bobbin of thread for use in the manufacture of the filter segment is provided. Preferably, the thread is formed from filter plug wrap having an air permeability ranging from about 6,000 Coresta units to about 24,000 Coresta units. Also preferably, the thread has a diameter ranging from about 0.5 mm to about 3 mm.

In yet another embodiment, a filter for a smoking article includes the filter segment. In still another embodiment, a multi-segment filter for a smoking article includes the filter segment at the mouth end thereof. In yet another embodiment a smoking article includes a filter including the filter segment described herein.

In still another embodiment, use of filter plug wrap having an air permeability ranging from about 6,000 Coresta units to about 24,000 Coresta units as a substrate for at least one smoke-modifying agent within the body of a filter segment for a filter for a smoking article is provided.

In yet another embodiment, a method of modifying smoke produced by a smoking article including a filter is provided. The method includes providing a substrate formed from filter plug wrap having an air permeability ranging from about 6,000 Coresta units to about 24,000 Coresta units loaded with at least one smoke-modifying agent within the body of a filter segment of the filter.

BRIEF DESCRIPTION OF THE DRAWINGS

The invention will be further described, by way of example only, with reference to the accompanying drawings wherein like reference numerals are applied to like elements and wherein.

DETAILED DESCRIPTION

Figure 1:
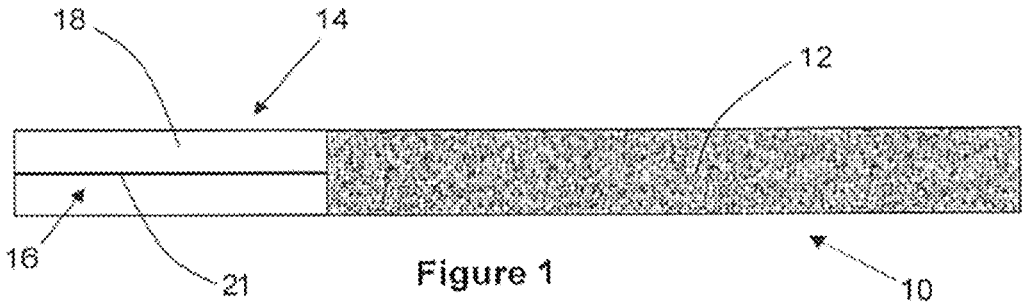
FIG. 1 shows a schematic longitudinal cross-section of a filter cigarette including a tobacco rod and a single segment filter according to a first embodiment of the invention.

In a preferred embodiment, a filter segment for use in a filter of a smoking article is provided. Preferably, the filter segment includes a substrate loaded with at least one smoke-modifying agent. Also preferably, the substrate is located within the body of the filter segment and is formed from filter plug wrap having an air permeability ranging from about 6,000 Coresta units to about 24,000 Coresta units.

As used herein, the air permeability in Coresta units is the amount of air in cubic centimeters that passes through one square centimeter of the filter plug wrap in one minute at a constant pressure difference of one kilopascal (that is, 1 Coresta unit corresponds to an air permeability of 1 $cm^3$/min $cm^2$ at a pressure differential of 1 kPa).

As used herein, the term 'filter segment' is used to describe a segment for use in a filter. Use of the term 'filter segment' does not signify that the segment has significant filtration effect. It will be appreciated that filter segments may have little or substantially no filtration effect.

Filter segments according to the invention may advantageously be used in filters for filter cigarettes and other smoking articles in which material is combusted to form smoke. Filter segments may also be used in smoking articles in which material is heated to form an aerosol, rather than combusted. In one type of heated smoking article, tobacco material or another aerosol forming material is heated by one or more electrical heating elements to produce an aerosol. In another type of heated smoking article, an aerosol is produced by the transfer of heat from a combustible fuel element or heat source to a physically separate aerosol forming material, which may be located within, around or downstream of the heat source.

As used herein, the term 'smoke' is used to describe smoke produced by combustible smoking articles, such as cigarettes, and aerosols produced by non-combustible smoking articles, such as heated smoking articles of the types described above.

As used herein, the term "filter plug wrap" is commonly used in the tobacco industry to describe the wrapper surrounding the filter rod of a filter cigarette. Filter plug wrap is commercially available from a large number of suppliers including, but not limited to: Schweitzer-Mauduit International Inc., Papeteries de Mauduit Mill, Quimperlé, France; Delfortgroup AG, for example, Papierfabrik Wattens GmbH & Co. KG, Wattens, Austria; Glatz Feinpapiere, Julius Glatz GmbH, Neidenfels, Germany; and Miguel y Costas & Miguel, S.A., Barcelona, Spain.

It will be appreciated that not all commercially available filter plug wrap is suitable for use in the present invention. Filter plug wrap suitable for use in the present invention has an air permeability ranging from about 6,000 Coresta units to about 24,000 Coresta units as measured in accordance with ISO 2965:2009.

Filter plug wrap having an air permeability ranging from about 6,000 Coresta units to about 24,000 Coresta units has excellent liquid absorption capability. Without wishing to be being bound by theory, the open structure of such filter plug wrap enables it to absorb large quantities of liquid. This advantageously enables substrates within the body of filter segments to be loaded with large quantities of smoke-modifying agents n use, the open structure of filter plug wrap having an air permeability ranging from about 6,000 Coresta units to about 24,000 Coresta units also advantageously facilitates the release of liquid absorbed by the filter plug wrap.

In contrast to filter plug wrap for use in the present invention, cigarette paper used to wrap the tobacco rod of filter cigarettes can have an air permeability ranging from about 10 Coresta units to about 300 Coresta units.

As stated above known flavor-bearing threads for use in filters are typically formed from cellulose acetate. Cellulose acetate is more expensive than filter plug wrap suitable for use in the present invention. The use of substrates formed from filter plug wrap in filter segments thus presents a significant cost advantage.

Preferably, filter plug wrap has an air permeability ranging from about 7,500 Coresta units to about 20,000 Coresta units, more preferably ranging from about 10,000 Coresta units to about 14,000 Coresta units as measured in accordance with ISO 2965:2009.

Capillary rise is also a measure of liquid absorption capability. Preferably, filter plug wrap has a capillary rise of at least about 40 mm, more preferably ranging from about 40 mm to about 130 mm, most preferably ranging from about 60 mm to about 120 mm as measured by the Klemm method in accordance with ISO 8787:1986.

Preferably, filter plug wrap has a sufficiently high tensile strength to resist breakage during the manufacture of filter segments. More preferably, filter plug wrap has a tensile breaking strength of at least about 20 N/15 mm at a constant rate of elongation of 8 mm/min for a sample width of 15 mm, as measured in accordance with the principles set out in ISO 1924-2:2008.

Preferably, filter plug wrap has a grammage ranging from about 18 g/$m^2$ to about 80 g/$m^2$, more preferably ranging from about 20 g/$m^2$ to about 50 g/$m^2$.

Filter plug wrap is preferably made from pulp including a mixture of short and long fibers. Short fibers include, but are not limited to: hardwood fibers such as aspen, beech, birch, chestnut, eucalyptus, gum, maple, oak, poplar and walnut. Long fibers include, but are not limited to: softwood fibers such as, for example, cedar, fir, pine, redwood and spruce; and non-wood fibers such as abaca, flax, hemp, kenaf and sisal.

The higher the air permeability of filter plug wrap, the more preferred is the inclusion of long fibers in the pulp from which the filter plug wrap is made. In such embodiments, the inclusion of long fibers in the pulp advantageously ensures that the filter plug wrap has an adequate tensile breaking strength, and so resistance to breakage during the manufacture of filter segments according to the invention.

Preferably, filter plug wrap is made from pulp including about 60% to about 90% by weight of softwood fibers (such as, for example, cedar, fir, pine, redwood, spruce and mixtures thereof), about 10% to about 40% by weight of hardwood fibers (such as, for example, aspen, beech, birch, chestnut, eucalyptus, gum, maple, oak, poplar, walnut and mixtures thereof) and about 0% to about 40% by weight of non-wood fibers (such as, for example, abaca, flax, hemp, kenaf, sisal and mixtures thereof).

Preferably, filter plug wrap is formed from filter plug wrap made from pulp including about 5% to about 30% by weight of sisal fibers.

Suitable filter plug wrap is commercially available from, for example, Schweitzer-Mauduit International Inc., Papeteries de Mauduit Mill, Quimperlé, France under the brand names PPW 120, PPW115ST and PPW 75ST.

The substrate formed from the filter plug wrap is loaded with at least one smoke-modifying agent. As used herein, the term "smoke-modifying agent" is used to describe any agent that, in use, modifies one or more features or properties of mainstream smoke passing through the filter segment. Suitable smoke-modifying agents include, but are not limited to, agents that, in use, impart a taste or aroma to mainstream smoke passing through the filter segment.

Preferably, the substrate is loaded with at least one flavorant. The substrate may be loaded with any flavorant or combination of flavorants capable of releasing flavor into mainstream smoke drawn through the filter segment.

Also preferably, the substrate may be loaded with two or more flavorants of the same or different types. For example, the substrate may be loaded with one or more natural flavorants or with one or more synthetic flavorants or with a combination of one or more natural flavorants and one or more synthetic flavorants.

Natural flavorants suitable for use in the invention include, but are not limited to, essential oils (for example, cinnamon essential oil, eucalyptus essential oil, peppermint essential oil and spearmint essential oil), oleoresins (for example, ginger oleoresin and clove oleoresin), absolutes (for example, cocoa absolute), fruit concentrates, botanical and fruit extracts (for example, blueberry extract, cranberry extract, geranium extract, green tea extract, orange extract and vanilla extract), and combinations thereof.

Synthetic flavorants suitable for use in the invention include, but are not limited to, synthetic menthol, synthetic vanillin and combinations thereof In a particularly preferred embodiment, substrate is loaded with menthol.

In the preferred embodiment, the substrate may be loaded with at least one liquid smoke-modifying agent by, for example, dipping, spraying or otherwise applying the at least one liquid smoke-modifying agent to the filter plug wrap.

Preferably, the substrate is an elongate substrate. More preferably, the substrate is a thread. As used herein, the term 'thread' is used to describe any elongate non-laminar substrate. For example, the substrate may be a thread formed from one or more twisted, braided or woven laminar strips of filter plug wrap.

Preferably, the elongate substrate has a diameter ranging from about 0.5 mm to about 3 mm, more preferably ranging from about 0.5 mm to about 2.5 mm, most preferably ranging from about 0.8 mm to about 2 mm.

In another embodiment, a bobbin of thread for use in the manufacture of a filter segment is provided. The thread is formed from filter plug wrap having an air permeability ranging from about 6,000 Coresta units to about 24,000 Coresta units and having a diameter ranging from about 0.5 mm to about 3 mm.

Preferably, the elongate substrate extends axially within the body of the filter segment. More preferably, the elongate substrate extends axially through the center of the filter segment.

Preferably, the length of the elongate substrate is substantially e al to the length of the filter segment.

Also preferably, the length of the substrate ranges from about 5 mm to about 22 mm, more preferably from about 8 mm to about 18 mm, most preferably about 15 mm.

However, filter segments may include substrates having other forms. For example, the substrate may be a ball or pellet of filter plug wrap.

Preferably, the filter segment includes a plug of filtration material, more preferably a plug of fibrous filtration material, most preferably a plug of cellulose acetate tow. In a particularly preferred embodiment of the invention, the filter segment includes a plug of cellulose acetate tow having a denier per filament ranging from about 1.5 to about 8.0 and a total denier ranging from about 15000 to about 46,000.

Preferably, the substrate is located within the plug of filtration material. Also preferably, the substrate extends axially through the plug of filtration material, More preferably, the substrate extends axially through the center of the plug of filtration material.

The substrate may, however, be located elsewhere within the body of the filter segment. For example, the substrate may be located in a cavity within the body of the filter segment.

Preferably, filter segments include a single substrate loaded with at least one smoke-modifying agent, more preferably a single elongate substrate loaded with at least one smoke-modifying agent, most preferably a single thread loaded with at least one smoke-modifying agent.

In a preferred embodiment, the filter segment includes a plug of filtration material and a single thread loaded with at least one flavorant extending axially through the center of the plug of filtration material. In a particularly preferred embodiment, the filter segment includes a plug of filtration material and a single elongate substrate loaded with menthol extending axially through the center of the plug of filtration material.

However, filter segments may include two or more substrates formed from filter plug wrap having an air permeability ranging from about 6,000 Coresta units to about 24,000 Coresta units, each of which is loaded with at least one smoke-modifying agent.

Filter segments may, for example, include two or more elongate substrates formed from filter plug wrap having an air permeability ranging from about 6,000 Coresta units to about 24,000 Coresta units, each of which is loaded with at least one smoke-modifying agent. For instance, filter segments may include a plug of filtration material with two or more threads formed from filter plug wrap having an air permeability ranging from about 6,000 Coresta units to about 24,000 Coresta units extending axially there through, each of which is loaded with at least one smoke-modifying agent.

Alternatively or in addition, filters may include two or more of balls or pellets formed from filter plug wrap having an air permeability ranging from about 6,000 Coresta units to about 24,000 Coresta units. For instance, filter segments may include a cavity containing a plurality of balls or pellets formed from filter plug wrap having an air permeability ranging from about 6,000 Coresta units to about 24,000 Coresta units extending axially there through, each of which is loaded with at least one smoke-modifying agent.

Where filter segments according to the invention include two or more substrates, the two more substrates may be loaded with the same or different smoke-modifying agent or agents.

Preferably, the filter segment has a resistance to draw (RTD) ranging from about 40 millimeters of water gauge (mm WG) to about 100 mm WG, more preferably a resistance to draw of about 70 mm WG as measured in accordance with ISO 6565:2002.

Preferably, the length of the filter segment ranges from about 5 mm to about 22 mm, more preferably ranges from about 8 mm to about 18 mm, most preferably about 15 mm.

In the preferred embodiment, filter segments may include substrates that are colored. Where filter segments include two or more substrates, the two or more substrates may be the same color or different colors.

Preferably, filter segments include one or more colored elongate substrates, more preferably one or more colored threads.

Preferably the one or more colored threads or other colored elongate substrates are of substantially the same length as the filter segment. In such embodiments, the one or more colored elongate substrates extend along the entire length of the filter segment, so as to be visible at each end thereof.

Where filter segments include one or more substrates loaded with at least one flavorant, the color of the one or more substrates may advantageously be used to indicate to a consumer the type of flavor imparted to mainstream smoke drawn through the filter segment by the at least one flavorant. For example, where the filter segment includes one or more substrates loaded with menthol, the one or more substrates are advantageously green in color.

Filter segments may be produced using existing methods and apparatus for forming known filter segments for filters for smoking articles. For example, filter segments including one or more axially extending elongate substrates loaded with at least one smoke-modifying agent may be produced using existing methods and apparatus for forming known filters including flavor-bearing cotton or cellulose acetate threads.

A filter for a smoking article including a filter segment as described herein is also provided.

As used herein, the term 'filter' is used to describe a mouthpiece for a smoking article. Use of the term 'filter' does not signify that the filter has significant filtration effect. It will be appreciated that filters may have little or substantially no filtration effect. This is particularly the case for filters for use in heated smoking articles of the types previously described above or other non-combustible smoking articles.

Preferably, the external diameter of filters ranges from about 4.5 mm to about 8.5 mm, more preferably from about 7.7 mm to about 8.1 mm, most preferably about 7.9 mm.

Preferably, the overall length of filters ranges from about 17 mm to about 36 mm, more preferably from about 24 mm to about 30 mm, most preferably about 27 mm.

Preferably, the overall encapsulated resistance to draw (RTD) of filters ranges from about 100 mm WG to about 180 mm WG as measured in accordance with ISO 6565:2002.

Filters according to the invention may be single segment filters.

Alternatively, filters according to the invention may be multi-segment filters including a filter segment and at least one additional filter segment.

Multi-segment filters may include one or more additional filter segments according to the invention or one or more additional filter segments not according to the invention or any combination thereof.

Multi-segment filters may include one or more additional filter segments upstream of the filter segment according to the invention. Alternatively or in addition, multi-segment filters may include one or more additional filter segments downstream of the filter segment according to the invention.

Throughout the specification, the terms 'upstream' and 'downstream' are used to describe the relative positions of components of filters according to the invention in relation to the direction of mainstream smoke drawn through the filters during use thereof.

Multi-segment filters according to the invention preferably include a filter segment according to the invention at the mouth end thereof (that is at the downstream end of the multi-segment filter). Where the filter segment includes one or more colored threads or other colored elongate substrates of substantially the same length as the filter segment, the downstream ends of the one or more colored elongate substrates at the mouth end of the multi-segment filter are thereby advantageously visible to a consumer. As previously stated above, the color of the substrates of filter segments may be used to indicate to a consumer the type of smoke-modifying agent with which the substrates are loaded. For example, where the multi-segment filter includes a filter segment including a substrate loaded with a flavorant, the color of the substrate may be used to indicate to a consumer the type of flavor released into the mainstream smoke by the filter segment during use of the multi-segment filter.

Preferably, the length of each individual filter segment of multi-segment filters ranges from about 5 mm to about 22 mm, more preferably from about 8 mm to about 18 mm, most preferably about 15 mm.

Multi-segment filters may include additional filter segments including, for example, one or more filtration materials, one or more sorbents, one or more catalysts, one or more flavorants or any combination thereof.

Suitable filtration materials for inclusion in additional filter segments of multi-segment filters include, but are not limited to, fibrous filtration materials such as, for example, cellulose acetate tow, paper and combinations thereof.

Suitable sorbents for inclusion in additional filter segments of multi-segment filters include, but are not limited to, activated carbon, activated alumina, zeolites, molecular sieves, silica gel and combinations thereof.

Suitable catalysts for inclusion in additional filter segments of multi-segment filters include, but are not limited to, catalysts for the conversion of carbon monoxide in mainstream smoke to carbon dioxide and catalysts for the conversion of nitric oxide in mainstream smoke to nitrogen such as, for example, iron oxide and copper oxide.

Suitable flavorants for inclusion in additional filter segments of multi-segment filters include, but are not limited to, those previously described above for use in the filter segment according to the invention.

Where multi-segment filters include a filter segment according to the invention including one or more substrates loaded with at least one flavorant and one or more additional filter segments including a flavorant, the one or more substrates of the filter segment may be loaded with the same or different flavorant or flavorants as the one or more additional segments.

In preferred embodiments, multi-segments filters include at least one filter segment according to the invention including a substrate loaded with at least one flavorant and at least one additional flavor release segment including a flavorant.

For example, multi-segment filters may include a filter segment according to the invention including a substrate loaded with at least one flavorant and an additional flavor release segment including a plurality of granules loaded with at least one flavorant. In one embodiment, the additional flavor release segment includes a plug of cellulose acetate tow having a plurality of granules loaded with at least one flavorant distributed substantially evenly therein. In another embodiment, the additional flavor release segment includes a cavity containing a plurality of botanical granules loaded with at least one flavorant.

However, it will be appreciated that multi-segment filters may include one or more additional flavor release segments of different construction.

For example, multi-segment filters may further include one or more additional flavor release segments including: plant leaf material (for example, shredded or cut tobacco or peppermint leaf); a plug of filtration material impregnated with one or more liquid flavorants (for example, a plug of cellulose acetate tow impregnated with menthol), a plurality of inert beads or granules loaded with one or more flavorants (for example, a plurality of cellulosic beads or granules loaded with menthol), or a combination thereof.

Alternatively or in addition, multi-segment filters may further include one or more additional flavor release segments according to the invention including a substrate formed from filter plug wrap having an air permeability ranging from about 6,000 Coresta units to about 24,000 Coresta units loaded with at least one flavorant.

Alternatively or in addition to one or more additional flavor release segments, multi-segment filters may include a rod end filter segment upstream of the filter segment according to the invention. Preferably, the rod end filter segment includes filtration material, more preferably a fibrous filtration material. The rod end filter segment may, for example, include cellulosic material, such as cellulose acetate tow, or other suitable fibrous filtration materials such as paper. The inclusion of a rod end filter segment including filtration material advantageously provides additional filtration efficiency. The inclusion of a rod end filter segment including a fibrous filtration material is particularly preferred in multi-segment filters according to the invention for use in filter cigarettes having a total tar delivery of about 6 mg or less.

Alternatively or in addition, the rod end filter segment may include at least one sorbent capable of removing at least one gas phase constituent from mainstream smoke drawn through the filter. Preferably, the at least one sorbent is selected from the group consisting of activated carbon, active alumina, zeolites, sepiolites, molecular sieves, silica gel and combinations thereof.

The rod end filter segment may include one or more flavorants to enhance flavor delivery to the consumer during smoking.

Preferably, the length of the rod end filter segment ranges from about 5 mm to about 14 mm, more preferably about 6 mm to about 8 mm.

It will be appreciated, however, that in multi-segment filters for use in filter cigarettes having a higher total tar delivery, for example a total tar delivery of about 6 mg or higher, the rod end filter segment may be omitted.

Alternatively or in addition to one or more additional flavor release segments and a rod end filter segment, multi-segment filters may include a mouth end filter segment downstream of the filter segment according to the invention. Preferably, the mouth end filter segment preferably has substantially no particulate phase filtration efficiency or very low particulate phase filtration efficiency. For example, the mouth end filter segment may include cellulosic material, such as cellulose acetate tow, or other suitable fibrous material of low filtration efficiency. Alternatively, the mouth end filter segment may consist of a hollow tube or recess located at the mouth end of the multi-segment filter that has substantially no filtration efficiency. Where the mouth end filter segment of a multi-segment filter is a hollow tube or recess, the mouth end filter segment may be formed when the multi-segment filter is attached to, for example, a rod of smokable material by tipping paper to form a combustible smoking article.

Preferably, the length of the mouth end filter segment ranges from about 3 mm to about 12 mm, more preferably from about 6 mm to about 8 mm. Where the mouth end filter segment includes a hollow tube or recess, the length of the mouth end filter segment preferably ranges from about 3 mm to about 6 mm.

Preferably, the mouth end filter segment has a resistance to draw of about 20 mm WG or less as measured in accordance with ISO 6565:2002.

A mouth end filter segment may advantageously be included downstream of the filter segment according to the invention to balance the overall resistance to draw of multi-segment filters in order to achieve a desired overall resistance to draw for a smoking article including the multi-segment filter. For example, where the mouth end filter segment includes a plug of cellulose acetate tow, the denier per filament and total denier of the tow may be selected in order to achieve a desired overall resistance to draw for the multi-segment filter. Preferably, where the mouth end filter segment includes a plug of cellulose acetate tow, the cellulose acetate tow has a denier per filament of about 5 or more.

The mouth end filter segment may include one or more flavorants to enhance flavor delivery to the consumer during smoking.

Preferably, multi-segment filters include a maximum of five filter segments.

Multi-segment filters may be produced by forming separate continuous rods including multiple units of each filter segment of the filter and then combining these separate rods in a known manner in one or more stages to form a continuous filter rod including multiple units of the multi-segment filter. The continuous filter rod may then be subsequently severed at regular intervals by a cutting mechanism to yield a succession of discrete multi-segment filters.

Filters according to the invention may be advantageously used as filters for "low tar" filter cigarettes, and in particular "low tar" ventilated filter cigarettes, having a total nicotine free dry particulate matter (NFDPM) or "tar" delivery ranging from about 4 mg to about 6 mg and "ultra low tar" filters cigarettes having a total nicotine free dry particulate matter (NFDPM) or "tar" delivery of about 3 mg or less.

However, it will be appreciated that single and multi-segment filters as described herein may be used as filters for filter cigarettes and other smoking articles having a higher total nicotine free dry particulate matter (NFDPM) or "tar" delivery, for example a total nicotine free dry particulate matter (NFDPM) or "tar" delivery of about 6 mg or more.

According to the invention there is also provided a smoking article including a filter as described herein.

In a preferred embodiment, smoking articles have an overall length ranging from about 68 mm to about 128 mm, more preferably about 84 mm.

Preferably, the smoking articles may be combustible smoking articles including a wrapped rod of smokable material and a filter as described herein. Preferably, the smokable material is tobacco cut filler. Also preferably, the rod of smokable material is wrapped in cigarette paper and the filter is attached to the rod of smokable material by tipping paper. The tipping paper may be transparent along at least a portion of its length.

Combustible smoking articles preferably further include at least one circumferential row of perforations at a location along the filter in order to ventilate mainstream smoke drawn through the filter from the rod of smokable material by a consumer.

Preferably, the at east one circumferential row of perforations is located at least 12 mm from the mouth end of the filter.

Also preferably, combustible smoking articles have a ventilation ranging from about 40% to about 80%, more preferably a ventilation of about 70% as measured in accordance with ISO 9512:2002.

Preferably, ventilated combustible smoking articles have a resistance to draw (RID) ranging from about 60 mm WG to about 110 mm WG as measured in accordance with ISO 6565:2002.

Preferably, combustible smoking articles have a total nicotine free dry particulate matter (NFDPM) or "tar" delivery ranging from about 0.2 mg to about 12 mg, more preferably ranging from about 4 mg to about 10 mg, most preferably of about 7 mg or less.

Smoking articles may alternatively be non-combustible smoking articles. For example, smoking articles may be heated smoking articles of the types previously described above.

According to the invention there is further provided a method of modifying smoke produced by a smoking article including a filter. The method includes providing a substrate formed from filter plug wrap having an air permeability ranging from about 6,000 Coresta units to about 24,000 Coresta units loaded with at least one smoke-modifying agent within the body of a filter segment of the filter.

According to the invention there is also provided use of filter plug wrap having an air permeability ranging from about 6,000 Coresta units to about 24,000 Coresta units as a substrate for at least one smoke-modifying agent within the body of a filter segment for a filter for a smoking article.

Table 1 illustrates the absorption capabilities of threads formed from filter plug wrap suitable for use in the present invention. Individual strips of filter plug wrap obtained from Schweitzer-Mauduit International Inc., Papeteries de Mauduit Mill, Quimperlé, France having the properties specified in Table 1 were manually twisted to form threads of the diameter specified in Table 1. The threads were weighed prior to being immersed in a solution including 85% synthetic menthol and 15% ethanol by weight for 10 seconds. The flavor-bearing threads were then removed from the solution and left for 10 minutes before being reweighed.

The absorption capability of each flavor-bearing thread was calculated as a percentage using the following equation:

$$\frac{(\text{weight of thread after immersion}) - (\text{weight of thread prior to immersion})}{(\text{weight of thread prior to immersion})} \times 100$$

The absorption capabilities for each thread sample recited in Table 1 are the average of the absorption capabilities measured for five individual flavor-bearing threads.

TABLE 1

| | Sample No. | | | |
|---|---|---|---|---|
| | 1 | 2 | 3 | 4 |
| | Brand name | | | |
| | PPW120 | PPW120 | PPW115ST | PPW75ST |
| Filter plug wrap | | | | |
| Width (mm) | 26.5 | 14.5 | 26.5 | 26.5 |
| Grammage (g/m$^2$) | 25.5 | 25.5 | 45 | 77.5 |
| Capillary rise (mm) | 64 | 64 | 110 | 120 |
| Tensile breaking strength (N/15 mm) | 22 | 22 | 34 | 84 |
| Air permeability (Coresta units) | 12000 | 12000 | 11500 | 7,500 |
| Flavor-bearing thread | | | | |
| Diameter (mm) | 1.5 | 1.0 | 2.2 | 2.8 |
| Absorption capability (%) | 112 | 116 | 165 | 142 |

Cigarette paper used to wrap the tobacco rods of filter cigarettes and tipping paper used to attach the wrapped tobacco rods of filter cigarettes to the filters thereof contain fillers such as, for example, calcium carbonate. Typically, cigarette paper includes about 40% filler. Some commercially available filter plug wrap also contain fillers.

In contrast, filter plug wrap having an air permeability ranging from about 6,000 Coresta units to about 24,000 Coresta units suitable for use in the present invention includes substantially no filler.

As illustrated by the data shown in Table 1, threads formed from filter plug wrap suitable for use in the present invention are capable of absorbing more than 100 percent of their own weight. This high absorption capacity advantageously enables threads and other substrates within filter segments according to the invention to be loaded with increased amounts of flavorants and other liquid smoke-modifying agents compared to cotton or cellulose acetate threads or yarns in known filters, and so to provide improved flavor enhancement to mainstream smoke during use.

The filter cigarettes 10, 20, 30, 40, 50 according to the first to fifth embodiments of the invention shown in FIGS. 1 to 5, respectively, have several components in common; these components have been given the same reference numerals.

Each filter cigarette generally includes an elongate, cylindrical wrapped tobacco rod 12 attached at one end to an axially aligned, elongate, cylindrical, filter 14, The wrapped tobacco rod 12 and the filter 14 are joined in a conventional manner by tipping paper (not shown), which circumscribes the entire length of the filter and an adjacent portion of the wrapped tobacco rod 12. A plurality of annular perforations (not shown) is provided through the tipping paper at a location along filter 14 to ventilate mainstream smoke drawn through the filter 14 with ambient air.

The single segment filter 14 of the filter cigarette 10 according to the first embodiment of the invention includes a single filter segment 16 adjacent to and abutting the wrapped tobacco rod 12. As shown in FIG. 1, the filter segment 16 includes a plug of cellulose acetate tow 18 and a central flavor-bearing thread 21 that extends axially through the plug of cellulose acetate tow 18 parallel to the longitudinal axis of the filter 14 and wrapped tobacco rod 12. The central flavor-bearing thread 21 is of substantially the same length as the plug of cellulose acetate tow 18, so that the ends of the central flavor-bearing thread 21 are visible at the ends of the filter segment 16. The central flavor-bearing thread 21, which is loaded with menthol, is formed from twisted filter plug wrap having an air permeability ranging from about 6,000 Coresta units to about 24,000 Coresta units.

During smoking of the filter cigarette 10, mainstream smoke is drawn downstream from the lit end of the wrapped tobacco rod 12 through the single segment filter 14 by the consumer. As the mainstream smoke enters the single segment filter 14 it passes through the filter segment 16, where the cellulose acetate tow filters out particulate phase components of the smoke and menthol is released into the mainstream smoke from the central flavor-bearing thread 21 extending axially through the cellulose acetate tow. The menthol loaded on the central flavor-bearing thread 21 of the filter segment 16 thus provides flavor enhancement to the mainstream smoke.

Figure 2:
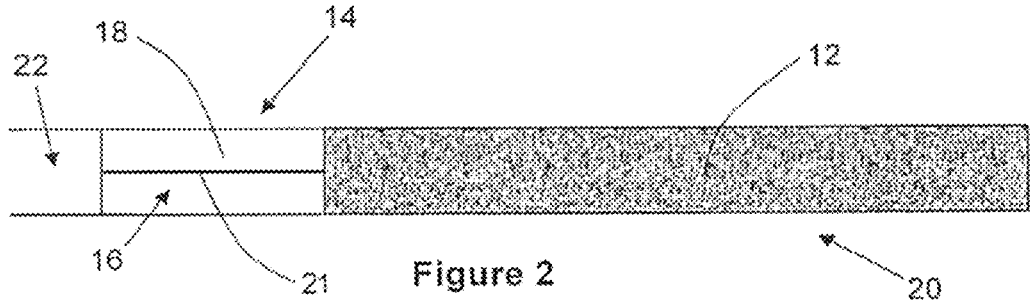
FIG. 2 shows a schematic longitudinal cross-section of a filter cigarette including a tobacco rod and a multi-segment filter according to a second embodiment of the invention.

The multi-segment filter 14 of the filter cigarette 20 according to the second embodiment of the invention shown in FIG. 2 includes two filter segments in abutting end-to-end relationship: a mouth end filter segment 22, distant from the wrapped tobacco rod 12; and a rod end filter segment 16 located upstream of the mouth end filter segment 22 and adjacent to and abutting the wrapped tobacco rod 12.

The rod end filter segment 16 of the multi-segment filter 14 of the filter cigarette 20 according to the second embodiment of the invention shown in FIG. 2 is of the same construction as the filter segment 16 of the single segment filter 14 of the filter cigarette 10 according to the first embodiment of the invention shown in FIG. 1.

The mouth end filter segment 22 of the multi-segment filter 14 of the filter cigarette 20 according to the second embodiment of the invention is a recess, which has substantially no filtration efficiency, formed by the tipping paper joining the wrapped tobacco rod 12 and the filter 14.

In an alternative embodiment of the invention (not shown), the mouth end filter segment 22 of the multi-segment filter 14 shown in FIG. 2 is replaced by a plug of cellulose acetate tow of low filtration efficiency. In this alternative embodiment, the mouth end filter segment 12 balances the overall resistance to draw of the multi-segment filter 14 and hence the filter cigarette.

Figure 3:
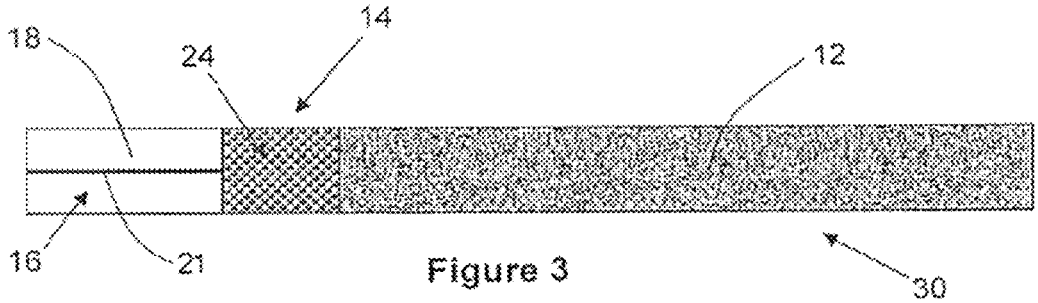
FIG. 3 shows a schematic longitudinal cross-section of a filter cigarette including a tobacco rod and a multi-segment filter according to a third embodiment of the invention.

The multi-segment filter 14 of the filter cigarette 30 according to the third embodiment of the invention shown in FIG. 3 also includes two filter segments in abutting end-to-end relationship: a mouth end filter segment 16 distant from the wrapped tobacco rod 12; and a rod end filter segment 24 located upstream of the mouth end filter segment 16 and adjacent to and abutting the wrapped tobacco rod 12.

The mouth end filter segment 16 of the multi-segment filter 14 of the filter cigarette 30 according to the third embodiment of the invention shown in FIG. 3 is of the same construction as the filter segment 16 of the single segment filter 14 of the filter cigarette 10 according to the first embodiment of the invention shown in FIG. 1.

The rod end filter segment 24 of the multi-segment filter 14 of the filter cigarette 30 according to the third embodiment of the invention includes a plug of cellulose acetate tow of high filtration efficiency having a plurality of granules loaded with menthol substantially evenly distributed there through.

In use, mainstream smoke drawn downstream from the lit end of the wrapped tobacco rod 12 of the filter cigarette 30 passes through the rod end filter segment 24 of the multi-segment filter 14, where the high filtration efficiency cellulose acetate tow partially filters out particulate phase components of the smoke and menthol is released into the mainstream smoke from the granules distributed in the cellulose acetate tow. The mainstream smoke then passes downstream through the mouth end filter segment 16, where the cellulose acetate tow also partially filters out particulate phase components of the smoke and further menthol is released into the mainstream smoke from the central flavor-bearing thread 21 extending axially through the cellulose acetate tow.

The cellulose acetate tow in the rod end filter segment 24 and mouth end filter segment 16 of the multi-segment filter 14 provides filtration of particulate phase components of the mainstream smoke. At the same time, the granules of the rod end filter segment 24 and the central flavor-bearing thread 21 of the mouth end filter segment 16 of the multi-segment filter 14 provide dual flavor enhancement to the mainstream smoke.

Figure 4:
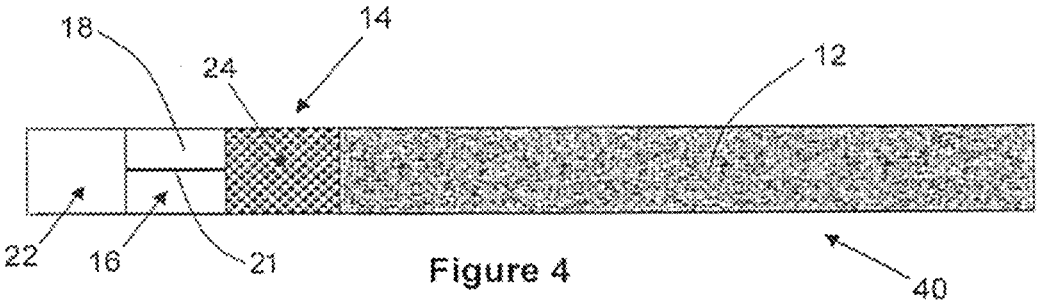
FIG. 4 shows a schematic longitudinal cross-section of a filter cigarette including a tobacco rod and a multi-segment filter according to a fourth embodiment of the invention.

The multi-segment filter 14 of the filter cigarette 40 according to the fourth embodiment of the invention shown in FIG. 4 includes three filter segments in abutting end-to-end relationship. The multi-segment filter 14 includes a rod end filter segment 24 of the same construction as the rod end filter segment 24 of the multi-segment filter 14 of the filter cigarette 30 according to the third embodiment of the invention shown in FIG. 3, The multi-segment filter 14 also includes a central filter segment 16 immediately downstream of the rod end filter segment 24 of the same construction as the filter segment 16 of the single segment filter 14 of the filter cigarette 10 according to the first embodiment of the invention shown in FIG. 1, In addition, the multi-segment filter 14 includes a mouth end filter segment 22 located downstream of the central filter segment 16 including a plug of cellulose acetate tow of low filtration efficiency. The mouth end filter segment 12 balances the overall resistance to draw of the multi-segment filter 14 and hence the filter cigarette 40.

In an alternative embodiment of the invention (not shown), the mouth end filter segment 22 of the multi-segment filter 14 shown in FIG. 4 is replaced by a recess, which has substantially no filtration efficiency, formed by the tipping paper joining the wrapped tobacco rod 12 and the filter 14.

Figure 5:
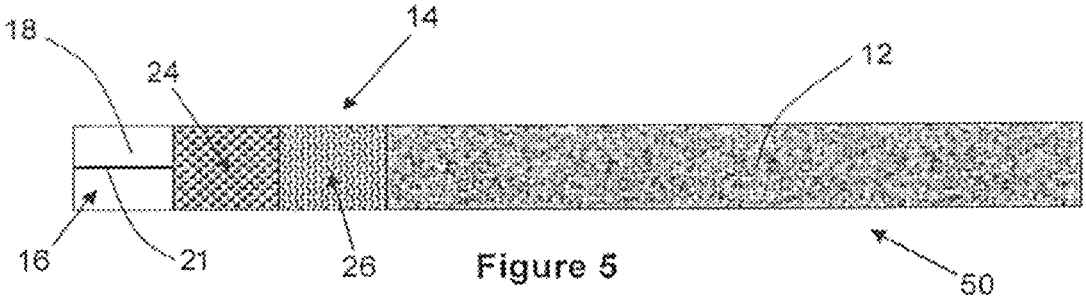
FIG. 5 shows a schematic longitudinal cross-section of a filter cigarette including a tobacco rod and a multi-segment filter according to a fifth embodiment of the invention.

The multi-segment filter 14 of the filter cigarette 50 according to the fifth embodiment of the invention shown in FIG. 5 also includes three filter segments in abutting end-to-end relationship. The multi-segment filter 14 includes a mouth end filter segment 16 of the same construction as the filter segment 16 of the single segment filter 14 of the filter cigarette 10 according to the first embodiment of the invention shown in FIG. 1. The multi-segment filter 14 also includes a central filter segment 24 immediately upstream of the mouth end filter segment 16 of the same construction as the rod end filter segment 24 of the multi-segment filter 14 of the filter cigarette 30 according to the third embodiment of the invention shown in FIG. 3. In addition, the multi-segment filter 14 includes a rod end filter segment 26 located upstream of the central filter segment 24 and adjacent to and abutting the wrapped tobacco rod 12. The rod end filter segment 26 includes a plug of cellulose acetate tow of medium to low filtration efficiency having a plurality of particles of activated carbon substantially evenly distributed there through.

In use, mainstream smoke drawn downstream from the lit end of the wrapped tobacco rod 12 of the filter cigarette 50 passes through the rod end filter segment 26 of the multi-segment filter 14, where the medium to low filtration efficiency cellulose acetate tow partially filters out particulate phase components of the mainstream smoke and the activated carbon distributed amongst the cellulose acetate tow filters out gas phase components of the mainstream smoke. The mainstream smoke then passes downstream through the central filter segment 24, where the high filtration efficiency cellulose acetate tow partially filters out particulate phase components of the smoke and menthol is released into the mainstream smoke from the granules distributed in the cellulose acetate tow. Finally, the mainstream smoke passes downstream through the mouth end filter segment 16, where the cellulose acetate tow also partially filters out particulate phase components of the smoke and further menthol is released into the mainstream smoke from the central flavor-bearing thread 21 extending axially through the cellulose acetate tow.

The cellulose acetate tow in the rod end filter segment 26, central filter segment 24 and mouth end filter segment 16 of the multi-segment filter 14 maximizes filtration of particulate phase components of the mainstream smoke, while the activated carbon distributed amongst the cellulose acetate tow of the rod end filter segment 26 of the multi-segment filter 14 maximizes filtration of gas phase components of the mainstream smoke. At the same time, the granules of the central filter segment 24 and the central flavor-bearing thread 21 of the mouth end filter segment 16 of the multi-segment filter 14 provide dual flavor enhancement to the mainstream smoke.

In further embodiments of the invention (not shown); a mouth end filter segment may be included downstream of the filter segment 16 of the multi-segment filter 14 of the filter cigarette 50 according to the fifth embodiment of the invention.

In yet further embodiments of the invention (not shown), the filter segments 24 including a plug of cellulose acetate tow of high filtration efficiency having a plurality of granules loaded with menthol substantially evenly distributed there through of the multi-segment filters 14 of the filter cigarettes 30, 40, 50 according to the third, fourth and fifth embodiments of the invention shown in FIGS. 3, 4 and 5, respectively, are replaced by filter segments including plant leaf.

For example, in certain alternative embodiments of the invention (not shown), the filter segments 24 including a plug of cellulose acetate tow of high filtration efficiency having a plurality of granules loaded with menthol substantially evenly distributed there through of the multi-segment filters 14 shown in FIGS. 3, 4 and 5 shown in FIGS. 3, 4 and 5 are replaced by filter segments including a plug of shredded or cut plant leaf, for example a plug of fine cut tobacco.

In other alternative embodiments of the invention (not shown), the filter segments 24 including a plug of cellulose acetate tow of high filtration efficiency having a plurality of granules loaded with menthol substantially evenly distributed there through of the multi-segment filters 14 shown in FIGS. 3, 4 and 5 are replaced by filter segments including a plug of filtration material having plant leaf distributed there through, for example a plug of cellulose acetate tow having dried peppermint leaf substantially evenly distributed there through.

In the multi-segment filters 14 of the filter cigarettes 30, 40, 50 according to the third, fourth and fifth embodiments of the invention shown in FIGS. 3, 4 and 5, respectively, the filter segment 24 including a plug of cellulose acetate tow of high filtration efficiency having a plurality of granules loaded with menthol substantially evenly distributed there through is located upstream of the filter segment 16. However, it will be appreciated that multi-segment filters may alternatively or additionally include an additional filter segment that releases flavor into the mainstream downstream of the filter segment. For example, in alternative embodiments of the invention (not shown), the relative positions of the filter segment 16 and the filter segment 24 including a plug of cellulose acetate tow of high filtration efficiency having a plurality of granules loaded with menthol substantially evenly distributed there through of the multi-segment filters 14 of the filter cigarettes 30, 40, 50 according to the third, fourth and fifth embodiments is reversed, such that the filter segment 16 is located upstream of the filter segment 24 including a plug of cellulose acetate tow of high filtration efficiency having a plurality of granules loaded with menthol substantially evenly distributed there through.

The multi-segment filters 14 of the filter cigarettes 30, 40, 50 according to the third, fourth and fifth embodiments of the invention shown in FIGS. 3, 4 and 5 include two flavor release segments: a filter segment 16 including a central flavor-bearing thread 21; and a filter segment 24 including a plug of cellulose acetate tow having a plurality of granules loaded with menthol substantially evenly distributed there through. However, it will be appreciated that multi-segment filters may include more than two flavor release segments. For example, in alternative embodiments (not shown), in addition to a filter segment including a substrate loaded with at least one flavorant, the multi-segment includes a second flavor release segment and a third flavor release segment of the same or different construction. In such embodiments, the filter segment including a substrate loaded with at least one flavorant may be located: (i) upstream of both the second and third flavor release segments; (ii) downstream of both the second and third flavor release segments; or (i) between the second and third flavor release segments. For example, in one alternative embodiment (not shown), the rod end filter segment of the multi-segment filter 14 of the filter cigarette 50 according to the fifth embodiment of the invention shown in FIG. 5 is replaced by a third flavor release segment of substantially the same construction as the mouth end filter segment 16.

To produce each of the multi-segment filters 14 of the filter cigarettes, 30, 40, 50 according to the second to fifth embodiments shown in FIGS. 2 to 5, separate continuous rods including multiple units of each segment 16, 22, 24, 26 of the multi-segment filter 14 are produced in a known manner and then combined to form a continuous filter rod including multiple units of the multi-segment filter 14. The continuous filter rod is then severed at regular intervals by a cutting mechanism to yield a succession of discrete multi-segment filters 14.

To form the filter cigarettes 10, 20, 30, 40, 50 according to the first to fifth embodiments shown in FIGS. 1 to 5, the filters 14 are produced and then joined to the wrapped tobacco rods 12, which are produced in a conventional manner, by tipping paper using known filter cigarette making equipment.

Example 1

A filter cigarette according to the third embodiment of the invention shown in FIG. 3 is produced having the dimensions and properties given in Table 2 below:

TABLE 2

| | Filter Cigarette |
|---|---|
| Encapsulated RTD (mm WG) | 95 |
| Length (mm) | 84 |
| Circumference (mm) | 24.8 |
| NFDPM (mg) | 4.8 |
| Nicotine (mg) | 0.43 |

| | Multi-segment filter | | Wrapped Tobacco rod |
|---|---|---|---|
| Encapsulated RTD (mm WG) | 106 | | — |
| Ventilation (%) | 51 | | — |
| Length (mm) | 27 | | 57 |
| Fiber segment: | Mouth end | Rod end | — |
| Length (mm) | 15 | 12 | — |
| RTD (mm WG) | 56 | 50 | — |
| Cellulose acetate: denier per filament | 2.7 | 3.7 | — |
| Cellulose acetate: total denier | 35000 | 35000 | — |
| Menthol loading (mg) | 7.8 | 7.0 | — |
| Substrate (mg) | 5.25 | — | — |
| Substrate and menthol (mg) | 13.05 | — | — |
| Diameter of substrate (mm) | 1.3 | | |
| Air permeability of filter plug wrap (Coresta units) | 12000 | | |
| Width of filter plug wrap (mm) | 14.5 | | |
| Tensile breaking strength of filter plug wrap (N/15 mm) | 22 | | |
| Capillary rise of filter plug wrap (mm) | 64 | | |
| Granules (mg) | — | 25 | — |

While the invention has been exemplified above with reference to smoking articles and filters that include a filter segment including a single, axially extending central thread, it will be appreciated that filters according to the invention may include segments including two or more axially extending, elongate substrates.

It will also be appreciated that filters according to the invention may include segments including one or more substrates of different form loaded with at least one smoke-modifying agent. For example, filters according to the invention may include one or more beads or pellets loaded with at least one smoke-modifying agent that are formed from filter plug wrap having an air permeability ranging from about 6,000 Coresta units to about 24,000 Coresta units.

In addition, while the invention has been exemplified above with reference to combustible smoking articles, it will be appreciated that filter segments according to the invention may also be used in filters for non-combustible smoking articles.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred filter segment including a single, axially extending central thread and methods of making with reference to a specific embodiment thereof, it will be apparent to one skilled in the art that various changes and modifications may be made to the filter segment including a single, axially extending central thread and equivalents method may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A filter for use in a tobacco article, the filter comprising:

at least one plug of filter material, the filter material including cellulose acetate;

at least one filter segment adjacent to the at least one plug of filter material, the filter segment including a plurality of granules;

a hollow tube adjacent to one of the at least one plug of filter material and the at least one filter segment;

a substrate loaded with a menthol solution, the substrate extending through at least a portion of the filter, the substrate having an air permeability ranging from about 7,500 Coresta units to about 24,000 Coresta units and a grammage ranging from 25 $g/m^2$ to 80 $g/m^2$, the substrate being formed of a twisted portion of a filter plug wrap having a diameter of 1.3 mm and a menthol load of about 7.8 mg.

2. The filter of claim 1, wherein the filter plug wrap has an air permeability ranging from about 10,000 Coresta units to about 14,000 Coresta units.

3. The filter of claim 1, wherein the substrate is colored.

4. The filter of claim 1, wherein the substrate extends axially within the filter.

5. The filter of claim 1, wherein the filter has a resistance to draw of about 40 mm $H_2O$ to about 100 mm $H_2O$.

6. The filter of claim 1, wherein the filter plug wrap is capable of absorbing more than 100 percent of its weight of menthol solution.

7. The filter of claim 1, wherein the cellulose acetate has a denier per filament of about 1.5 to about 8 and a total denier of about 15,000 to about 46,000.

8. The filter of claim 1, wherein the granules comprise at least one flavorant.

9. The filter of claim 1, wherein the granules comprise menthol.

10. A tobacco article comprising:

a tobacco rod; and a filter attached to the tobacco rod by tipping paper, the filter including, at least one plug of filter material, the filter material including cellulose acetate;

at least one filter segment adjacent to the at least one plug of filter material, the filter segment including a plurality of granules;

a hollow tube adjacent to one of the at least one plug of filter material and the at least one filter segment;

a substrate loaded with a menthol solution, the substrate extending through at least a portion of the filter segment, the substrate having an air permeability ranging from about 7,500 Coresta units to about 24,000 Coresta units and a grammage ranging from 25 $g/m^2$ to 80 $g/m^2$, the substrate being formed of a twisted portion of a filter plug wrap having a diameter of 1.3 mm and a menthol load of about 7.8 mg.

* * * * *